United States Patent [19]

Snow

[11] 4,144,969

[45] Mar. 20, 1979

[54] BENEFICIATION OF PHOSPHATE ORE

[75] Inventor: Robert E. Snow, Lakeland, Fla.

[73] Assignee: International Minerals & Chemical Corp., Terre Haute, Ind.

[21] Appl. No.: 788,070

[22] Filed: Apr. 18, 1977

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,748,939 | 6/1956 | Hodges | 209/166 |
| 3,177,985 | 10/1939 | Harris | 209/166 |
| 3,259,242 | 7/1966 | Snow | 209/166 |
| 3,361,257 | 1/1968 | Nasemon | 209/166 |
| 3,482,688 | 12/1969 | Bishell | 209/166 |
| 4,043,455 | 8/1977 | Gisend | 209/167 |

*Primary Examiner*—Robert Halper

*Attorney, Agent, or Firm*—E. A. Figg; H. E. Post

[57] ABSTRACT

A method is disclosed for beneficiating an apatitic phosphate ore containing an alkaline earth metal carbonate mineral impurity, which includes conditioning the phosphate ore in an aqueous conditioning slurry containing a cationic reagent at a concentration sufficient to reagentize the ore; and subjecting the reagentized ore to a froth flotation process wherein the apatite is recovered in the froth concentrate and the alkaline earth metal carbonate mineral impurity is rejected in the underflow tailing.

13 Claims, No Drawings

BENEFICIATION OF PHOSPHATE ORE

BACKGROUND OF THE INVENTION

The present invention relates to a froth flotation method for the beneficiation of phosphate ore. More particularly, it relates to a method for beneficiating an apatitic phosphate ore containing an alkaline earth metal carbonate mineral impurity.

Apatite is a common mineral and appears in small amounts in practically all igneous rocks. Concentrations rich enough to justify mining are found in many localities. The mineral apatite is a phosphate of lime containing varying amounts of chlorine, fluorine, carbonate and hydroxyl. The phosphorus pentoxide content of various apatites ranges from 32 to 42 percent. The fluorine content has ranged as high as 3.8 percent but generally is about 3.3 percent in fluorapatite.

For the major uses of apatite, the mineral is preferably in concentrated form. The phosphate industry requires, for the production of fertilizers, superphosphate, triple superphosphate and phosphoric acid, a phosphatic material of relatively high BPL content and imposes price penalties where impurities are present in excess of certain maximum fixed percentages. The term "bone phosphate of lime," commonly abbreviated to BPL, is generally used to express the phosphate content of fertilizers. It is the equivalent of $Ca_3(PO_4)_2$. In the analysis of phosphatic materials, the chemist generally reports the phosphorus content in terms of phosphorus pentoxide ($P_2O_5$).

In order to be attractive on a commercial scale, a process for beneficiating a phosphate ore should produce a phosphate concentrate which is substantially free of gangue minerals. Many methods have been devised to beneficiate phosphate ores. Froth flotation beneficiation of phosphate minerals is commercially practiced on phosphate ores in which silicate minerals are the predominant gangue.

Such beneficiation generally comprises comminuting and classifying into various particle sizes. Coarser fractions may be suitable for direct sale or may be further beneficiated by sizing and skin flotation techniques. Extremely fine material, e.g. −150 mesh, which pirmarily contains clay slimes, is usually discarded. The intermediate fraction having a particle size range of −20 +150 mesh poses the greatest beneficiation problems.

The "Crago" or "double float" froth flotation process is commercially used for beneficiating such fractions of phosphate ores in which silicate minerals are the predominant gangue. That process consists of conditioning the material with fatty acid reagents, flotation of the phosphate mineral, deoiling with sulfuric acid to remove the reagents, and refloating with amine reagents to remove the siliceous gangue which either floated or was trapped in the rougher float.

Many phosphate ores contain carbonate gangue materials in addition to silicate minerals. Alkaline earth metal carbonate minerals are common impurities in certain ore deposits. Such minerals include calcite ($CaCO_3$), dolomite $Ca,MgCO_3$), sea shells, aragonite, dolomitic limestone, and other less common minerals.

The "double float" process has generally been ineffective for beneficiating such ores. Snow, R. E., U.S. Pat. No. 3,259,242, July 5, 1966 teaches the beneficiation of calcitic-apatite ores in which the apatite is in the crystalline form. The method has not, however, been found satisfactory for sedimentary deposits of ores containing oolitic or non-crystalline apatite or for dolomitic ores.

Such mineral impurities dilute the BPL content of the ores and may also interfere in subsequent processing and chemical reactions involving the ore. For instance, carbonate minerals present in phosphate ores used to produce phosphoric acid, superphosphate, or triple superphosphate consume sulfuric acid in the acidulation steps without providing additional fertilizer values. The lowering of dolomite concentrations in ores to be used in the production of phosphoric acid and phosphate fertilizers is particularly important, because relatively small amounts of magnesium have a deleterious effect on the conversion of phosphate rock to phosphoric acid and, hence, to other fertilizer materials. Heretofore, no generally satisfactory method has been discovered for beneficiating sedimentary phosphate ores containing alkaline earth metal carbonate mineral impurities.

SUMMARY OF THE INVENTION

In accordance with this invention, there is disclosed a method for beneficiating a phosphate ore having a particle size range of from about 325 mesh (44μ) to about 16 mesh (991μ) containing substantially discreet particles of apatite and an alkaline earth metal carbonate mineral impurity and containing less than about 20 wt. % siliceous minerals, by a froth flotation process, which comprises:

conditioning the phosphate ore at an apatite-reagentizing pH, in an aqueous conditioning slurry containing an apatite-collecting cationic reagent in an amount of from about 0.2 to about 5.0 lb per ton (about 0.1 to about 2.5 g per kg) of phosphate ore at a concentration of from about 0.04 to about 7.0 g per liter of water in the conditioning slurry, and containing a cationic reagent-extending amount of a normally liquid hydrocarbon, thereby forming a reagentized phosphate ore; and subjecting the reagentized phosphate ore to froth flotation wherein a substantially greater amount of the apatite from the phosphate ore is recovered in the froth concentrate and a substantially greater amount of the alkaline earth metal carbonate mineral impurity is rejected in the underflow tailings.

DETAILED DESCRIPTION OF THE INVENTION

Phosphate ores which are beneficiated by the method of this invention advantageously have a particle size such that the apatite and the alkaline earth metal carbonate mineral occur in substantially discreet particles. The ores may naturally exist in such particle sizes, or, if not, may be comminuted and classified to desired particle size ranges by methods known in the art. A particle size smaller than about 16 mesh (about 991μ), preferably smaller than about 24 mesh (about 701μ), is usually employed. With larger particle sizes, an appreciable quantity of the gangue minerals may remain locked with the apatite. Furthermore, the larger ore particles are sometimes difficult to float. Very small particles, e.g. smaller than about 325 mesh (about 44μ) or, more preferably, smaller than about 150 mesh (about 105μ), are generally removed in a process called "desliming." Although the slimes may contain significant apatite values, their relatively large consumption of reagents makes their beneficiation currently economically unattractive.

Such ores are advantageously low in siliceous mineral gangues, e.g. silica or metallic silicates. It has been found that the flotation reagents employed in the present method have a greater affinity for such siliceous minerals than for apatite, thus if siliceous minerals are present, the reagentization of apatite is difficult unless inordinately large amounts of reagent are employed. Ores containing siliceous gangue are preferably first beneficiated by conventional techniques, such as the "double float" froth flotation process, to concentrate the phosphatic values and substantially reduce the concentration of siliceous gangue. Phosphate beneficiated by the present method advantageously contain less than about 20 wt. % siliceous minerals, preferably, less than about 10 wt. % of such minerals.

In practicing the present method, the phosphate ore is first subjected to a conditioning step. In the conditioning step, the ore is reagentized in an aqueous conditioning slurry with an apatite-collecting cationic reagent. Such reagents include higher aliphatic amines, e.g. from about 10 to about 24 carbon atoms, and their salts with water-soluble acids; the esters of amino alcohols with high molecular weight fatty acids and their salts with water-soluble acids; the higher alkyl-O-substituted isoureas and their salts with water-soluble acids; the reaction product of polyalkylene polyamines with fatty acids or fatty acid triglycerides; the higher alkyl pyridinium salts of water-soluble acids; the higher quinolinium salts of water-soluble acids; rosin amines and their salts with water-soluble acids and the like.

The preferred cationic reagents are higher aliphatic amines or their acetate salts, e.g. amines having from about 6 to 20 carbon atoms, preferably about 8 to 18 carbon atoms or their acetate salts.

The conditioning slurry contains such cationic reagent in an amount sufficient to reagentize substantially all of the apatite present in the ore. Such amounts have generally been found to be in the range of from about b 0.2 to about 5.0 lb of reagent per ton of phosphate ore (about 0.1 to about 2.5 g reagent per kilogram of ore). Preferred amounts of reagent range from about 0.5 to about 2.0 lb per ton of ore (about 0.25 to about 1.0 g per kg of ore).

The concentration of the cationic reagent in the conditioning slurry has also been found important in reagentizing the apatite. Relatively high concentrations of the cationic reagent, as compared to reagent concentrations in analogous processes, have been found to provide superior results. Concentrations in the range of from about 0.04 to about 7.0 g of cationic reagent per liter of water in the conditioning slurry are generally employed, with preferred concentrations falling in the range of from about 0.3 to about 2.5 g of reagent per liter of water. Using sufficient cationic reagent to reagentize the apatite while maintaining the concentration of cationic reagent in the conditioning slurry in the desired range, means that the conditioning slurry will contain a relatively high percentage of solids, e.g. on the order of from about 30% to 75% solids, preferably from about 55% to about 75% solids.

During conditioning, the conditioning slurry is maintained at an apatite-reagentizing pH. To maintain such pH, any suitable acid or base may be added to the slurry. The pH of the conditioning slurry is advantageously maintained within a range of from about 3.5 to about 9. A pH below about 3.5 to 4.0 is difficult to maintain if substantial quantities of carbonate minerals are present because of their buffering effect. The preferred pH range, for optimum reagentization of the apatite, is from about 4.5 to about 7.0, most preferably from about 5.0 to about 6.5.

Acids which may be employed to maintain the pH of the conditioning slurry in the desired range, include mineral acids and lower carboxylic acids, e.g. having from 1 to about 4 carbon atoms, which do not react deleteriously with the ore or the cationic reagent. Suitable acids include, for instance, acetic acid, phosphoric acid, hydrochloric acid, nitric acid, and hydrofluoric acid. Suitable bases include ammonia and inorganic hydroxides or carbonates such as sodium or potassium hydroxide or sodium or potassium carbonate. Sulfuric acid, which appears to react with the ore to form insoluble gypsum ($CaSO_4$), and which may react with the cationic reagent to form an insoluble salt, and citric acid, which is thought to form complexes with certain species in the ore, have been found generally unsatisfactory in the present method. Preferred acids are acetic acid, phosphoric acid, hydrofluoric acid, and hydrochloric acid and the preferred base is ammonia.

The effect of the cationic reagent is extended by a normally liquid hydrocarbon (i.e. a hydrocarbon which is liquid at ambient temperatures generally encountered in a mineral processing plant), such as kerosene, mineral oil, mineral spirits, fuel oil, or mixtures thereof. Conventionally, cationic reagents are used in solution, as an emulsion, or as a dispersion in such liquid hydrocarbon as a carrier medium. The hydrocarbon cooperates with the cationic reagent and acts to increase the non-polar coating on the ore particles. The hydrocarbon may be employed in an extending amount, and such amount will vary with the particular hydrocarbon and cationic reagent used. Generally, the liquid hydrocarbon is employed at a weight to weight ratio of hydrocarbon to cationic reagent of from about 0.5:1 to about 7:1, preferably at a ratio of from about 2:1 to about 5:1.

The addition of fluoride ion to the conditioning slurry has surprisingly been found to have beneficial effects on apatite recovery and removal of the carbonate impurities under certain circumstances. Any suitable source of fluoride ions may be employed. For instance, hydrofluoric acid or water-soluble fluoride salts may be used. Fluoride salts, such as sodium fluoride, potassium fluoride, ammonium fluoride, ammonium bifluoride, etc. may be the economically preferred sources of fluoride ions. The beneficial effect of fluoride ions is most realized at higher pH's, e.g. from about 7 to about 9. Thus, the preferred pH range for conditioning may be extended upward by the addition of a source of fluoride ions. If a source of fluoride ions is employed, the fluoride concentration is usually from about 0.3 to about 5 lb per ton of phosphate ore (about 0.15 to about 2.5 g per kg of ore). The beneficial effect of the fluoride ion is not usually observed at concentrations lower than about 0.3 lb per ton of ore, and amounts greater than about 5.0 lb per ton of ore generally provide no additional advantages. Preferred concentrations of fluoride ions range from about 0.5 to about 3 lb per ton of ore (about 0.25 to about 1.5 g per kg of ore).

The conditioning of the phosphate ore may be conducted in any suitable equipment, e.g., an agitated vessel or in a conventional flotation cell, as is well known in the art.

The conditioning time and temperature fall within the ranges usually employed in analogous processes. For instance, conditioning times generally range from about 0.5 to about 5 minutes, and conditioning temperatures may range from about 15° C. to about 50° C.

Following conditioning, the reagentized ore concentrate is subjected to froth flotation employing any of the standard flotation equipment known in the art. It will be apparent that a battery of units in parallel or in series may be employed for the flotation. The number of stages of flotation to which the ore is subjected, the retention time in each cell, the temperature of the pulp, and other conditions depend on the characteristics of the ore and the desired purity of the concentrate. The determination of these parameters is within the ability of one skilled in the wet mineral processing art. The pH ranges and the means of controlling pH, which were hereinbefore discussed for the conditioning step, are also applicable to the flotation conditions.

The flotation is effective to remove, in the froth overflow, a substantial amount of the apatite values of the mixture. The underflow contains a substantial portion of the alkaline earth metal carbonate mineral impurities.

The invention is further illustrated by the following examples, which are not intended to be limiting.

Unless otherwise indicated, the following terms have the indicated meanings in the examples: "Composited Head" means the phosphate ore which is the raw material for the process. The "Composited Heads" have been classified by particle size or comminuted approximately −28 +150 mesh, amd beneficiated by the standard "double float" technique. In a multi-stage flotation, in which a plurality of flotation cells are operated in series (i.e. the concentrate from one cell provides the feed for the next cell), the first flotation is called "Rougher Float," the second — the "Cleaner Float," the third — the "Recleaner Float," the fourth — the "Re-recleaner Float," and so on. "Tail" is that material which is rejected in the underflow. "Concentrate" is that material which is recovered in the overflow. "Percent BPL" means the weight percentage of phosphate in a fraction, calculated as bone phosphate of lime ($Ca_3(PO_4)_2$). "BPL Units" is calculated by multiplying the weight percent of a fraction by that fraction's percent BPL. "Percent Distribution BPL" is that proportion of the total BPL of the feed which is present in a given fraction and in the final concentrate, represents the recovery for the process. The concentration of dolomite is indicated by MgO content, and the concentration of calcite is indicated by CaO content or the $CaO/P_2O_5$ ratio. Percent INSOL indicates the weight percentage of insolubles, primarily siliceous minerals. Numbers in parentheses are calculated figures.

EXAMPLE I

A 500 g sample of dolomitic Florida phosphate ore concentrate, having a particle size range of approximately 31 28 +150 mesh, which was the product of a conventional "double float" beneficiation process was conditioned at about 70 wt. % solids for 15 seconds with 1.0 lb HF per ton of ore (0.5 g per kg), then for an additional 30 seconds with 1 lb of Armac T* cationic reagent and 3 lb of kerosene per ton of ore. The pH of the conditioning slurry was 5.4 and the temperature of the slurry was 22° C. The reagentized ore was subjected to rougher, cleaner, recleaner, re-recleaner flotation at about 22 wt. % solids in a laboratory Denver flotation cell. The material balance shown in Table A was obtained.

*Armac T is a trademark of Armour Industrial Chemicals Company for a technical grade mixture of fatty amine acetates derived from tallow fatty acids.

The ore concentrate was upgraded from 64.23% BPL to 66.47% BPL, and the MgO content was decreased about 1.54% to 0.98% with a BPL recovery of 95.2%.

Table A

| product | Wt. g | % Wt. | % BPL | % Insol | % MgO | BPL Units | % Dist BPL |
|---|---|---|---|---|---|---|---|
| Re-Recleaner Concentrate | 437.7 | 92.0 | 66.47 | 2.22 | 0.98 | 61.15 | 95.2 |
| Re-Recleaner Tail | 6.5 | 1.4 | 57.09 | 3.16 | 3.52 | 0.80 | 1.2 |
| Recleaner Tail | 7.5 | 1.6 | 52.38 | 3.22 | 4.72 | 0.84 | 1.3 |
| Cleaner Tail | 8.5 | 1.8 | 42.74 | 3.36 | 7.70 | 0.77 | 1.3 |
| Rougher Tail | 13.4 | 2.8 | 24.07 | 3.85 | 13.20 | 0.67 | 1.0 |
| Composite Head | 437.5 | 100.0 | (64.23) | (2.30) | (1.54) | 64.23 | 100.0 |

Table B

| Product | Wt. g | % Wt. | % BPL | % Insol | % MgO | BPL Units | % Dist BPL |
|---|---|---|---|---|---|---|---|
| Re-Recleaner Concentrate | 448.0 | 94.0 | 66.62 | 1.89 | 0.93 | 62.62 | 96.3 |
| Re-Recleaner Tail | 15.0 | 3.1 | 56.32 | 2.39 | 4.10 | 1.75 | 2.7 |
| Recleaner Tail | 5.0 | 1.1 | 37.34 | 3.23 | 9.20 | 0.41 | 0.6 |
| Cleaner Tail | 4.0 | 0.8 | 19.71 | 4.05 | 13.90 | 0.16 | 0.3 |
| Rougher Tail | 4.5 | 1.0 | 9.50 | — | 16.60 | 0.09 | 0.1 |
| Composite Head | 476.5 | 100.0 | (65.03) | — | (1.38) | 65.03 | 100.0 |

EXAMPLE II

The experiment of Example I was repeated in all essential details except that HF was omitted from the conditioning slurry. The pH of the conditioning slurry was about 7.1. The material balance shown in Table B was obtained.

The ore concentrate was upgraded from 65.03% BPL to 66.62% BPL, and the MgO content was decreased from 1.38% to 0.93% with a BPL recovery of 96.3%.

EXAMPLE III

The experiment of Example I was repeated in all essential details except phosphoric acid was substituted for hydrofluoric acid. The pH of the conditioning slurry was 5.3. The material balance shown in Table C was obtained.

The ore concentrate was upgraded from 64.86% BPL to 66.40% BPL, and the MgO content was decreased fromm 1.46% to 1.02% with a BPL recovery of 85.81%.

EXAMPLE IV

The experiment of Example I was repeated in all essential details except acetic acid was substituted for hydrofluoric acid. The pH of the conditioning slurry was 5.2. The material balance shown in Table D was obtained.

The ore concentrate was upgraded from 64.64% BPL to 66.08% BPL, and the MgO content was decreased from 1.46% to 1.08% with a BPL recovery of 98.7%.

Table C

| Product | Wt. g | % Wt. | % BPL | % Insol | % MgO | BPL Units | % Dist BPL |
|---|---|---|---|---|---|---|---|
| Re-Recleaner Concentrate | 402.2 | 83.8 | 66.40 | 1.87 | 1.02 | 55.64 | 85.8 |
| Re-Recleaner Tail | 50.3 | 10.5 | 64.14 | 1.55 | 1.80 | 6.73 | 10.4 |
| Recleaner Tail | 18.0 | 3.8 | 53.76 | 1.98 | 4.80 | 2.04 | 3.1 |
| Cleaner Tail | 6.3 | 1.3 | 28.42 | 3.23 | 11.50 | 0.37 | 0.6 |
| Rougher Tail | 3.1 | 0.6 | 14.01 | — | 15.50 | 0.08 | 0.1 |
| Composite Head | 479.9 | 100.0 | (64.86) | — | (1.46) | 64.86 | 100.0 |

Table D

| Product | Wt. g | % Wt. | % BPL | % Insol | % MgO | BPL Units | % Dist BPL |
|---|---|---|---|---|---|---|---|
| Re-Recleaner Concentrate | 458.3 | 96.6 | 66.08 | 1.87 | 1.08 | 63.83 | 98.7 |
| Re-Recleaner Tail | 5.1 | 1.1 | 46.23 | 2.64 | 6.80 | 0.51 | 0.8 |
| Recleaner Tail | 3.0 | 0.6 | 25.56 | — | 12.50 | 0.15 | 0.2 |
| Cleaner Tail | 2.0 | 0.6 | 12.63 | — | 15.70 | 0.07 | 0.1 |
| Rougher Tail | 5.0 | 1.1 | 7.12 | 4.64 | 16.20 | 0.08 | 0.2 |
| Composite Head | 474.2 | 100.0 | (64.64) | — | (1.46) | 64.64 | 100.0 |

EXAMPLE V

The experiment of Example I was repeated in all essential details except 0.8 lb per ton of ammonia and 2.0 lb per ton of sodium fluoride were substituted for hydrofluoric acid. The pH of the conditioning slurry was 9.1. The material balance shown in Table E was obtained.

The ore concentrate was upgraded from 64.93% BPL to 66.04% BPL, and the MgO content was decreased from 1.33% to 1.03% with a BPL recovery of 97.9%.

Table E

| Product | Wt. g | % Wt. | % BPL | % Insol | % Mgo | BPL Units | % Dist BPL |
|---|---|---|---|---|---|---|---|
| Re-Recleaner Concentrate | 460.00 | 96.3 | 66.04 | 2.19 | 1.03 | 63.60 | 97.9 |
| Re-Recleaner Tail | 5.9 | 1.2 | 41.54 | 3.28 | 7.80 | 0.50 | 0.8 |
| Recleaner Tail | 4.8 | 1.0 | 35.12 | 3.26 | 9.40 | 0.35 | 0.5 |
| Cleaner Tail | 4.9 | 1.0 | 31.24 | 3.20 | 10.70 | 0.31 | 0.5 |
| Rougher Tail | 2.2 | 0.5 | 34.94 | 2.76 | 9.80 | 0.17 | 0.3 |
| Composite Head | 477.8 | 100.0 | (64.93) | — | (1.33) | 64.93 | 100.0 |

EXAMPLE VI

A 500 g sample of comminuted calcitic Indian phosphate ore* was conditioned for 15 seconds with 1.0 lb per ton of dextrin, ** then for an additional 15 seconds with 2.0 lb per ton of hydrofluoric acid, and finally for an additional 30 seconds with 1.5 lb per ton of Armac T plus 3.0 lb per ton of kerosene. Conditioning % solids was 70%, and conditioning pH was approximately 6.4. The reagentized ore slurry was diluted to 22% solids and subjected to rougher-cleaner-recleaner-re-recleaner flotation in a laboratory Denver cell. The material balance shown in Table F was obtained.

* −48 +325 Mesh

** Used to aid calcite depression.

Table F

| Product | Wt. g | % Wt. | % BPL | % Insol | % MgO | % CaO | CaO/$P_2O_5$ | % Dist BPL |
|---|---|---|---|---|---|---|---|---|
| Re-Recleaner Concentrate | 342.1 | 70.2 | 64.54 | 5.99 | 0.62 | 47.37 | 1.60 | 88.4 |
| Re-Recleaner Tail | 20.9 | 4.3 | 33.75 | 6.07 | 1.47 | 47.36 | 3.07 | 2.8 |
| Recleaner Tail | 25.0 | 5.1 | 26.96 | 5.42 | 1.53 | 48.14 | 3.90 | 2.7 |
| Cleaner Tail | 33.8 | 6.9 | 17.20 | 4.88 | 1.65 | 48.72 | 6.19 | 2.3 |
| Rougher Tail | 65.5 | 13.5 | 14.34 | 5.25 | 1.74 | 49.10 | 7.48 | 3.8 |
| Composite Head | 487.3 | 100.0 | (51.25) | (5.79) | (0.92) | (47.74) | (2.03) | 100.0 |

EXAMPLE VII

The experiment of Example I was repeated in all essential details except that 4.0 lb per ton of sodium fluoride plus 0.5 lb per ton of hydrochloric acid were substituted for the hydrofluoric acid, and 0.6 lb per ton of a crude fatty amine mixture* plus 1.8 lb per ton of kerosene was used as the phosphate collector. Conditioning % solids was 68%, and the conditioning pH was 6.4. All tailings from this test were combined, and the simplified material balance shown in Table G was obtained.

* Sold under the trademark Armoflote P of Armour Industrial Chemicals Company

The upgraded concentrate assayed 1.07% MgO - % BPL was increased from 62.51 to 64.85% at an overall BPL recovery of 96.7%.

EXAMPLE VIII

The experiment of Example I was repeated in all essential details except that 3.0 lb per ton of ammonium bifluoride plus 1.0 lb per ton of acetic acid were substituted for hydrofluoric acid, and 1.5 lb per ton of The process yielded a concentrate assaying 64.54% BPL, 0.62 MgO and $CaO/P_2O_5$ = 1.60 at 88.4% BPL recovery from a feed assaying 51.25% BPL, 0.92% MgO and $CaO/P_2O_5$ = 2.03. The phosphate was jet black in color, whereas the carbonate minerals varied from white or colorless to stained gray-black. The BPL upgrading obtained resulted from the rejection of both calcite and dolomite into the tailings.

dicocodimethylammonium chloride** was substituted for Armac T and 4.5 lb per ton of kerosene was used. Conditioning % solids was 68%, and conditioning pH was 5.8. All tailings were combined, and the simplified material balance shown in Table H was obtained.

** Sold under the trademark Arquad 2C-75 of Armour Industrial Chemicals Company

The upgraded concentrate assayed 1.06% MgO - % BPL was increased from 62.51 to 64.85% at an overall BPL recovery of 66.3%.

Table G

| Product | Wt. g | % Wt. | % BPL | % Insol | % MgO | BPL Units | % Dist BPL |
|---|---|---|---|---|---|---|---|
| Amine Recleaner Concentrate | 480.8 | 93.2 | 64.85 | 3.53 | 1.07 | 60.44 | 96.7 |
| Combined Tail | 35.2 | 6.8 | (30.44) | (4.41) | (9.71) | 2.07 | 8.3 |
| Analytical Head | 516.0 | 100.0 | 62.51 | 3.59 | 1.66 | 62.51 | 100.0 |

Table H

| Product | Wt. g | % Wt. | % BPL | % Insol | % MgO | BPL Units | % Dist BPL |
|---|---|---|---|---|---|---|---|
| Amine Recleaner Concentrate | 329.3 | 63.8 | 64.98 | 3.59 | 1.06 | 41.46 | 66.3 |
| Combined Tail | 187.0 | 36.2 | (58.15) | (3.59) | (2.71) | 21.05 | 33.7 |
| Analytical Head | 516.3 | 100.0 | 62.51 | 3.59 | 1.66 | 62.51 | 100.0 |

EXAMPLES IX–XXXI

The experiment of Example I was repeated, using a different ore concentrate, in all essential details for each of the examples listed in Table I, except reagents and conditions were modified as indicated. Only the re-recleaner concentrate was analyzed. The analytical head for these examples analyzed 64.23% BPL, 2.30% Insol, and 1.54% MgO.

EXAMPLE XXXII

A 500 g sample of a conventional "double float" Florida phosphate ore concentrate*, different from that of previous examples, was conditioned at about 55% solids for 15 seconds with 2.0 lb per ton (1.0 g per kg) of hydrofluoric acid, then for an additional 30 seconds with 0.6 lb per ton (0.3 g per kg) of Armac T and 1.2 lb per ton (0.6 g per kg) of kerosene. The conditioned material pulp** was diluted to about 22% solids and subjected to rougher-cleaner-recleaner flotation in a laboratory Denver cell. The material balance shown in Table J was obtained.

* −28 +150 Mesh

** pH − 4.8

The upgraded concentrate assayed only 0.98% MgO - % BPL was increased from 60.03 to 66.51% at an overall BPL recovery of 97.1%. Phosphate was brown-black; dolomite tails cream-colored.

Table I

| Example Number | Cationic Reagent | Lb. Cationic Reagent Per Ton of Ore | % Solids in Conditioning Slurry | Liquid Hydrocarbon | Lb. Liquid Hydrocarbon Per Ton of Ore | pH Controlling Agent | pH of Conditioning Slurry | Other Conditions or Reagents (lb Per Ton Ore | Product % BPL | % Insol | % MgO | % BPL Dist |
|---|---|---|---|---|---|---|---|---|---|---|---|---|
| IX | Armac T | 0.4 | 70 | Kerosene | 1.2 | HF | 4.7 | — | 66.19 | 3.77 | 0.93 | 46.2 |
| X | Armac T | 0.8 | 70 | Kerosene | 2.4 | HF | 5.0 | — | 64.88 | 3.72 | 1.16 | 98.3 |
| XI | Armac T | 0.6 | 70 | Kerosene | 3.6 | HF | 5.3 | — | 64.95 | 3.91 | 1.11 | 99.4 |
| XII | Armac T | 0.6 | 63 | Kerosene | 1.8 | HF | 4.9 | — | 66.01 | 3.07 | 1.03 | 91.9 |
| XIII | Armac T | 0.6 | 53 | Kerosene | 1.8 | HF | 4.9 | — | 66.54 | 3.38 | 0.96 | 77.7 |
| XIV | Custamine 3010* | 0.6 | 70 | Kerosene | 1.8 | HF | 5.3 | — | 64.48 | 5.68 | 1.00 | 28.1 |
| XV | Custamine | 1.2 | 70 | Kerosene | 3.6 | HF | — | — | 65.39 | 3.95 | 1.13 | 78.2 |
| XVI | Armac T | 0.6 | 70 | Kerosene | 1.8 | $H_2SO_4$ | 4.7 | — | NO FLOTATION | | | |
| XVII | Armac T | 0.6 | 70 | Kerosene | 1.8 | $H_2SO_4$ | 6.5 | — | 65.64 | 3.49 | 10.84 | 83.4 |
| XVIII | Armac T | 0.6 | 70 | Kerosene | 1.8 | Acetic Acid | 4.8 | — | 65.36 | 3.89 | 1.05 | 98.6 |
| XIX | Armac T | 0.6 | 70 | Kerosene | 1.8 | Citric Acid | 4.5 | — | NO FLOTATION | | | |
| XX | Armac T | 0.6 | 70 | Kerosene | 1.8 | Citric Acid | 6.5 | — | 64.44 | 7.08 | 0.88 | 13.2 |
| XXI | Armac T | 0.6 | 70 | Kerosene | 1.8 | $HNO_3$ | 4.6 | — | 65.50 | 3.61 | 1.07 | 62.3 |
| XXII | Armac T | 0.6 | 70 | Kerosene | 1.8 | $HNO_3$ | 6.4 | — | 65.32 | 3.58 | 1.03 | 94.9 |
| XXIII | Armac T | 0.6 | 70 | Kerosene | 1.8 | $NH_3$ | 9.3 | NaF(2.0) | 63.83 | 3.60 | 1.09 | 90.9 |
| XXIV | Custamine 3010 | 2.0 | 70 | Kerosene | 6.0 | HF | 5.2 | — | 64.85 | 3.55 | 1.16 | 98.9 |
| XXV | Armac T | 0.8 | 70 | No. 5 Fuel Oil | 2.4 | HF | 4.9 | — | 65.26 | 3.52 | 1.07 | 97.7 |
| XXVI | Armac T | 0.6 | 70 | Mineral Spirits | 1.8 | HF | 4.9 | — | 66.04 | 3.52 | 1.00 | 76.4 |
| XXVII | Armac T | 0.6 | 70 | White Mineral Oil | 1.8 | HF | 4.9 | — | 64.95 | 4.16 | 0.96 | 93.9 |
| XXVIII | Armac T | 0.6 | 70 | Kerosene | 1.8 | HF | — | 4° C Conditioning | NO FLOTATION | | | |
| XXIX | Armac T | 0.6 | 70 | Kerosene | 1.8 | HF | — | 14° C Conditioning | 66.87 | 3.36 | 0.82 | 49.3 |
| XXX | Armac T | 0.6 | 70 | Kerosene | 1.8 | HF | — | 45° C Conditioning | 66.58 | 3.63 | 1.00 | 97.7 |
| XXXI | Armac T | 0.6 | 70 | Kerosene | 1.8 | HF | — | 58° C Conditioning | 65.64 | 3.44 | 0.93 | 87.9 |

*Custamine 3010 is a trademark of Westvaco Company for a product obtained by the condensation of two moles of tall oil fatty acid with one mole of diethylenetriamine.

EXAMPLE XXXIII

The procedure of Example XXXII was repeated in all essential details except that an ore concentrate derived from a different part of the same ore body was used. The material balance shown in Table K was obtained.

The upgraded concentrate assayed only 0.82% MgO - the % BPL was increased from 59.40 to 65.62% at an overall BPL recovery of 98.2%. Phosphate was brown-black; dolomite tails creasm-colored.

Table J

| Product | Wt. g | % Wt. | % BPL | % Insol | % MgO | BPL Units | % Dist BPL |
|---|---|---|---|---|---|---|---|
| Amine Recleaner Concentrate | 432.2 | 87.6 | 66.51 | 3.47 | 0.98 | 58.26 | 97.1 |
| Amine Recleaner Tail | 11.8 | 2.4 | 26.87 | 3.82 | 12.56 | 0.64 | 1.1 |
| Amine Cleaner Tail | 15.2 | 3.1 | 15.82 | 3.86 | 13.46 | 0.49 | 0.8 |
| Amine Rougher Tail | 34.2 | 6.9 | 9.22 | 3.73 | 14.60 | 0.64 | 1.0 |
| Composite Head | 493.4 | 100.0 | (60.03) | (3.51) | (2.59) | 60.03 | 100.0 |

Table K

| Product | Wt. g | % Wt. | % BPL | % Insol | % MgO | BPL Units | % Dist BPL |
|---|---|---|---|---|---|---|---|
| Amine Recleaner Concentrate | 439.4 | 88.9 | 65.62 | 3.64 | 0.82 | 58.34 | 98.2 |
| Amine Recleaner Tail | 11.6 | 2.3 | 16.22 | 3.35 | 11.70 | 0.37 | 0.6 |
| Amine Cleaner Tail | 11.2 | 2.3 | 12.06 | 3.76 | 12.39 | 0.28 | 0.56 |
| Amine Rougher Tail | 32.0 | 6.5 | 6.27 | 3.55 | 18.66 | 0.41 | 0.7 |
| Composite Head | 494.2 | 100.0 | (59.40) | (3.64) | (2.49) | 59.40 | 100.0 |

I claim:

1. A method for beneficiating a phosphate ore having a particle size range of from about 325 mesh (about 44μ) to about 16 mesh (about 991μ), containing substantially discreet particles of apatite and alkaline earth metal carbonate mineral impurity, by a froth flotation process, which comprises:

conditioning the phosphate ore, which contains less than about 20 weight % siliceous minerals and which is an oolitic, sedimentary ore, at a pH of from about 4.5 to about 7.0, in an aqueous conditioning slurry having a solids content of from about 55 weight % to about 75 weight % and containing an apatite-collecting cationic reagent in an amount of from about 0.2 to about 5.0 lb per ton (about 0.1 to about 2.5 g per kg) of phosphate ore and containing a normally liquid hydrocarbon in a weight to weight ratio of hydrocarbon to cationic reagent of from about 2:1 to about 5:1, thereby forming a reagentized phosphate ore; and subjecting the reagentized phosphate ore to a froth flotation, wherein a substantially greater amount of the apatite from the phosphate ore is recovered in the froth concentrate and a substantially greater amount of the alkaline earth metal carbonate mineral impurity is rejected in the underflow tailings.

2. The method of claim 1 wherein said phosphate ore has a particle size range of from about 150 mesh (about 105μ) to about 24 mesh (about 701μ), contains less than about 10 weight % siliceous minerals, and is a concentrate from a conventional "double float" froth flotation beneficiation process.

3. The method of claim 2 wherein the cationic reagent is selected from the group consisting of higher aliphatic amines and their salts with water-soluble acids; the esters of amino alcohols with high molecular weight fatty acids and their salts with water-soluble acids; the higher alkyl-O-substituted isoureas and their salts with water-soluble acids; the higher aliphatic quaternary ammonium bases and their salts with water-soluble acids; the reaction product of polyalkylene polyamines with fatty acids or fatty acid triglycerides; the higher alkyl pyridinium salts of water-soluble acids; the higher quinolinium salts of water-soluble acids; and rosin amine and its salts with water-soluble acids; and the normally liquid hydrocarbon is selected from the group consisting of kerosene, fuel oil, mineral oil, and mineral spirits.

4. The method of claim 3 wherein the pH of the conditioning slurry is maintained in the range of from about 5.0 to about 6.5; the cationic reagent is employed in an amount of from about 0.5 to about 2.0 lb per ton of phosphate ore; and the liquid hydrocarbon is employed at a weight to weight ratio of hydrocarbon to cationic reagent of about 3:1.

5. The method of claim 2 wherein the pH of the conditioning slurry is maintained in the range of from about 5.0 to about 6.5; the cationic reagent is employed in an amount of from about 0.5 to about 2.0 lb per ton of phosphate ore; and the liquid hydrocarbon is employed at a weight to weight ratio of hydrocarbon to cationic reagent of about 3:1.

6. The method of claim 5 wherein the cationic reagent is selected from the group consisting of higher aliphatic amines of from about 6 to about 20 carbon atoms and their salts with water-soluble acids; and the liquid hydrocarbon is kerosene or fuel oil.

7. The method of claim 6 wherein the pH of the conditioning slurry is maintained with an acid selected from the group consisting of acetic acid, phosphoric acid, hydrochloric acid, nitric acid, and hydrofluoric acid, or a base selected from the group consisting of ammonia, sodium hydroxide and potassium hydroxide.

8. The method of claim 1 wherein the cationic reagent is selected from the group consisting of higher aliphatic amines and their salts with water-soluble acids; the esters of amino alcohols with high molecular weight fatty acids and their salts with water-soluble acids; the higher alkyl-O-substituted isoureas and their salts with water-soluble acids; the higher aliphatic quaternary ammonium bases and their salts with water-soluble acids; the reaction product of polyalkylene polyamines with fatty acids or fatty acid triglycerides; the higher alkyl pyridinium salts of water-soluble acids; the higher quinolinium salts of water-soluble acids; and rosin amine and its salts with water-soluble acids; and the normally liquid hydrocarbon is selected from the group consisting of kerosene, fuel oil, mineral oil, and mineral spirits.

9. The method of claim 1 wherein the pH of the conditioning slurry is maintained in the range of from about 5.0 to about 6.5; the cationic reagent is employed in an amount of from about 0.5 to about 2.0 lb per ton of phosphate ore; and the liquid hydrocarbon is employed at a weight to weight ratio of hydrocarbon to cationic reagent of about 3:1.

10. The method of claim 1 wherein the phosphate ore contains less than about 10 weight % siliceous minerals.

11. A method for beneficiating a phosphate ore having a particle size range of from about 325 mesh (about 44μ) to about 16 mesh (about 991μ), containing substantially discreet particles of apatite and alkaline earth metal carbonate mineral impurity, by a froth flotation process, which comprises:

conditioning the phosphate ore, which contains less than about 20 weight % siliceous minerals and which is an oolitic, sedimentary ore, at a pH of from about 7 to about 9 in an aqueous conditioning slurry having a solids content of from about 55 weight % to about 75 weight % and containing an apatite-collecting cationic reagent in an amount of from about 0.2 to about 5.0 lb per ton (about 0.1 to about 2.5 g per kg) of phosphate ore and containing a normally liquid hydrocarbon in a weight to weight ratio of hydrocarbon to cationic reagent of from about 2:1 to about 5:1, and further containing a source of fluoride ions in an amount such that the fluoride concentration is from about 0.3 to about 5 lb per ton (about 0.15 to about 2.5 g per kg) of phosphate ore, thereby forming a reagentized phosphate ore; and subjecting the reagentized phosphate ore to a froth flotation, wherein a substantially greater amount of the apatite from the phosphate ore is recovered in the froth concentrate and a substantially greater amount of the alkaline earth metal carbonate mineral impurity is rejected in the underflow tailings.

12. The method of claim 11 wherein the source of fluoride ions is selected from the group consisting of hydrofluoric acid and water-soluble fluoride salts.

13. The method of claim 11 wherein the source of fluoride ions is selected from the group consisting of hydrofluoric acid, sodium fluoride, potassium fluoride, ammonium fluoride, and ammonium bifluoride and is employed in an amount such that the fluoride concentration is about 0.5 to about 3.0 lb per ton (about 0.25 to 1.5 g per kg) of phosphate ore.

* * * * *

UNITED STATES PATENT AND TRADEMARK OFFICE

CERTIFICATE OF CORRECTION

PATENT NO. : 4,144,969

DATED : March 20, 1979

INVENTOR(S) : Robert E. Snow

It is certified that error appears in the above-identified patent and that said Letters Patent are hereby corrected as shown below:

Column 1, line 62, "Ca,$MgCO_3$)" should read -- (Ca,$MgCO_3$) --
Column 3, line 38, following "about", delete the letter -- b --
Column 5, line 47, following "comminuted", insert -- to --
Column 5, line 48, "amd" should read -- and --
Column 6, line 7, "31 28 + 150" should read -- -28 + 150 --
Column 6, line 23, "about" should read -- from --
Column 6, line 64, "fromm" should read -- from --
Column 6, line 64, "85.81% should read -- 85.8% --
Table G, last column, "8.3" should read -- 3.3 --
Table I, Example XV, second column, "Custamine" should read -- Custamine 3010 --
Table I, under the heading "Other Conditions or Reagents", the phrase "(lb Per Ton Ore" should read -- (lb Per Ton Ore) --
Table I, Example XVII, twelfth column, "10.84" should read -- 0.84 --
Table I, Example XXVII, fifth column, "White Mineral" should read -- White Mineral Oil --
Table I, Example XXVII, ninth column, delete "Oil"
Column 11, line 11, "creasm" should read -- cream --
Table K, column eight, "0.56" should read -- 0.5 --

Signed and Sealed this

Fourth Day of September 1979

[SEAL]

Attest:

Attesting Officer

LUTRELLE F. PARKER
Acting Commissioner of Patents and Trademarks